United States Patent [19]

Baclit

[11] 4,295,293

[45] Oct. 20, 1981

[54] NURSING BOTTLE HOLDER

[76] Inventor: Paul S. Baclit, 2167 College View Dr., Monterey Park, Calif. 91754

[21] Appl. No.: 137,289

[22] Filed: Apr. 4, 1980

[51] Int. Cl.[3] ..... A63H 17/26; A47D 15/00

[52] U.S. Cl. ..... 46/202; 46/106; 46/32; 248/106

[58] Field of Search ..... 46/32, 99, 106, 107, 46/112, 202, 205, 232, 222, 223; 248/105, 106, 107, 123.1, DIG. 10; 128/134; 84/94 C, 95 C; 180/166; 280/1.13, 1.1 A, 1.188, 1.189

[56] References Cited

U.S. PATENT DOCUMENTS

| | | | |
|---|---|---|---|
| 2,484,414 | 10/1949 | Mahan | 84/95 C |
| 2,802,444 | 8/1957 | Gilmour | 84/95 C X |
| 3,172,390 | 3/1965 | Garthofner | 84/95 C X |
| 3,222,020 | 12/1965 | Rea | 248/106 |
| 3,416,625 | 12/1968 | Narutani | 280/1.13 UX |
| 3,620,491 | 11/1971 | Baclit | 248/106 |
| 3,648,958 | 3/1972 | Araujo | 248/105 |
| 3,721,042 | 3/1973 | Marason | 46/223 |

*Primary Examiner*—F. Barry Shay
*Attorney, Agent, or Firm*—Paul H. Gallagher

[57] ABSTRACT

The device includes a main support member in the form of a shell which fits over the body of the infant when the infant is lying down; an upright bottle support removably mounted on the main support for mounting the bottle, this bottle support having a caricature thereon such as of an animal; a bottle carriage on the bottle support, pivoted between an active position in which an infant feeds, and an inactive position in which it is inclined away from the infant's face, and having a weight for moving it to inactive position when the bottle is released; the bottle support includes a music box which is activated by the bottle carriage when the latter is moved to inactive position; and the main support while carrying the bottle support is demountably positionable on a pull-toy, such as a buggy which, together as a combination toy can be enjoyed by an older child.

2 Claims, 11 Drawing Figures

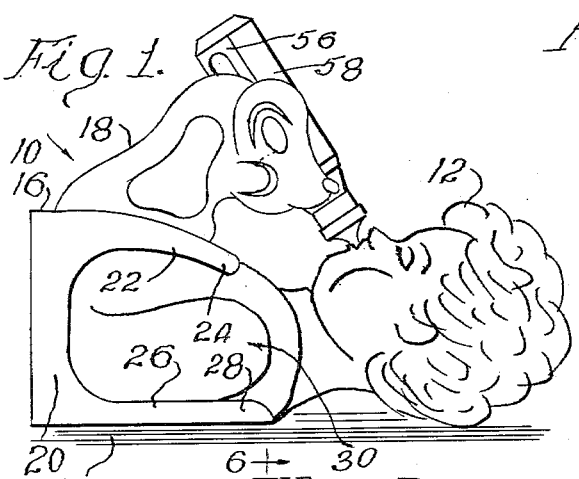
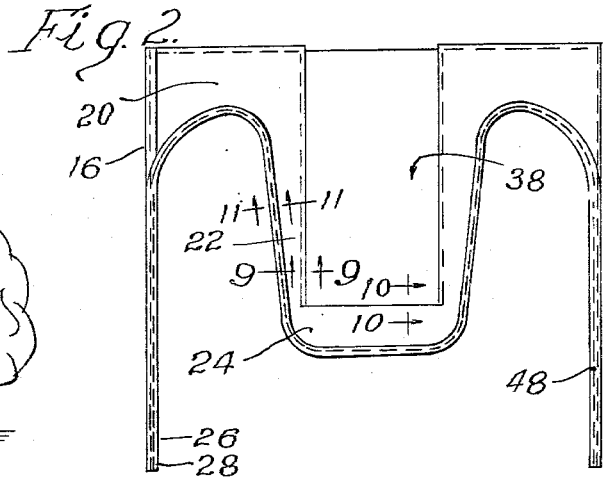
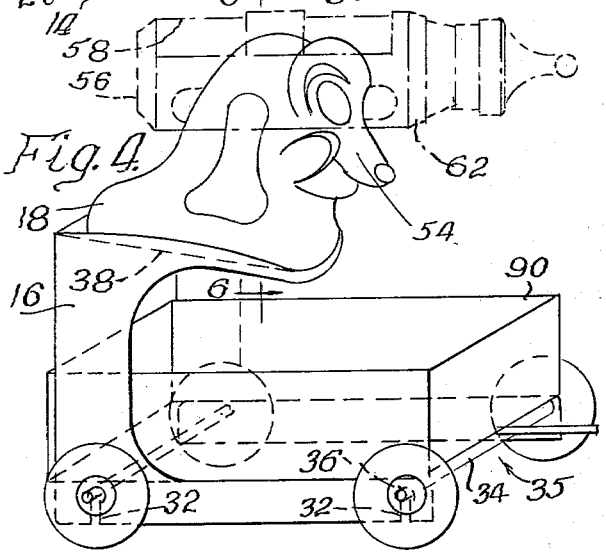
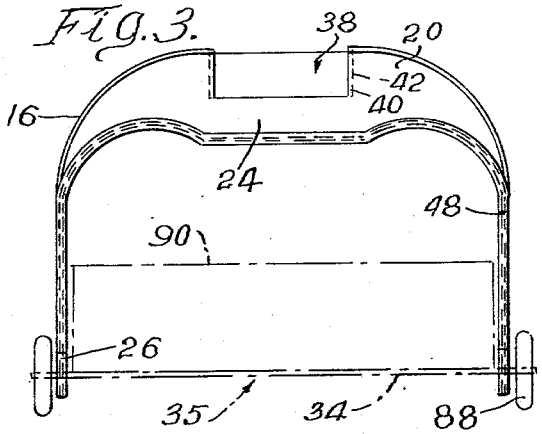
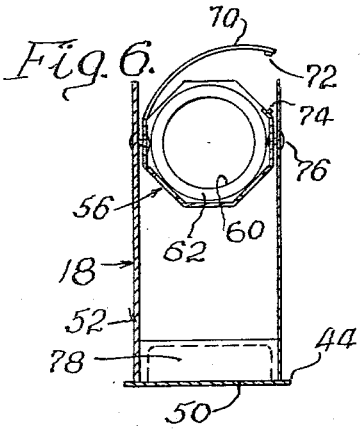
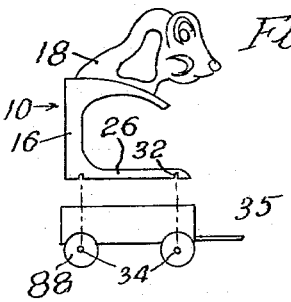
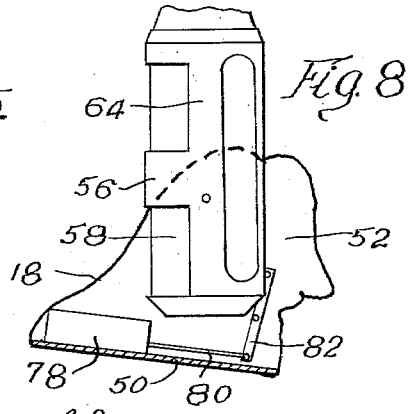
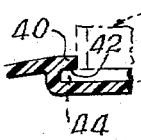
Fig. 9.
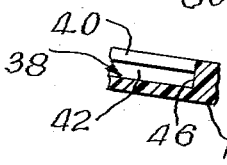
Fig. 10.
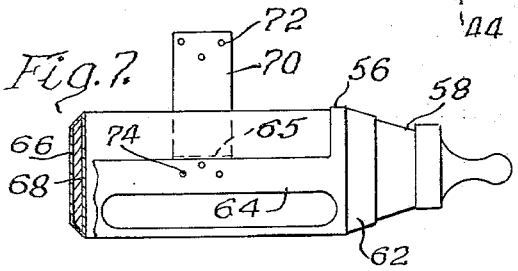
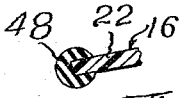
Fig. 11.

NURSING BOTTLE HOLDER

OBJECTS OF THE INVENTION

A broad object of the invention is to provide a nursing bottle holder which includes a main support member positionable over an infant when the infant is lying down and in which a nursing bottle is positioned for moving to an active position in which the infant can feed from the bottle, and an inactive position in which the bottle is moved away from the face of the infant, including as its novel features:

(a) a music box having a normal off position when the bottle is in its active position, and which is activated by the bottle when the bottle is released by the infant and it moves to inactive position;

(b) a device of the character referred to specially designed for cooperation with a complementary toy, and the two together then constituting a combination by;

(c) a device of the foregoing character having a simple construction both in overall combination, and in which each of the components is of simple construction, thereby resulting in an economical device, and further, one which presents an unusually attractive appearance.

DESCRIPTION OF A PREFERRED EMBODIMENT

In the drawings:

FIG. 1 is a side elevational view of the nursing bottle holder in position with an infant, and with the infant feeding therefrom;

FIG. 2 is a top view of the lower component of the nursing bottle holder shown in FIG. 1;

FIG. 3 is an end view of the lower component shown in FIG. 2, taken from the direction of the observer;

FIG. 4 is a perspective view of the device applied to a pull-toy and thus forming a new combination toy;

FIG. 5 is a simplified view of the device of the invention and the pull-toy in spaced relation, and indicating the step of applying the device to the pull-toy;

FIG. 6 is a sectional view of the bottle holder, which constitutes the upper component of the device shown in FIGS. 1 and 4, taken essentially at line 6—6 of FIG. 4;

FIG. 7 is a view according to line 7—7 of FIG. 6 but with a portion of the bottle carriage in section;

FIG. 8 is a simplified view of the upper component of the device partially broken away and showing the nursing bottle in inactive position, and its relation to the music box which is activated by the bottle;

FIG. 9 is a detail sectional view taken at line 9—9 of FIG. 2;

FIG. 10 is a detail sectional view taken at line 10—10 of FIG. 2; and FIG. 11 is a detail sectional view taken at line 11—11 of FIG. 2.

Referring to detail to the accompanying drawings, attention is directed first to FIG. 1 showing the nursing bottle holder, indicated at its entirety at 10, applied to an infant 12 lying on its back on a surface 14 which may be a bed, a rug, etc. The nursing bottle holder includes two main components, a lower main support member 16 and an upright bottle support 18 mounted on the support member 16.

Both the main support member 16 and bottle support 18 may be made of any suitable material, preferably a plastic material, which can be readily formed or fabricated to the desired shape by presently known methods.

Preferably the member 16 is of integral construction except for an edging element referred to hereinbelow.

The following description is based on the device being oriented according to the infant lying on its back as represented in FIG. 1, and the expressions upper and lower are related to the head of the infant and body, respectively, horizontally as viewed in FIG. 1, while the expressions top and bottom relate to the vertical orientation as viewed in that figure. The member 16 includes a lower continuous transverse element 20 and a top wall element 22 extending upwardly, toward the head of the infant and terminating in a free end 24. The member 16 also includes side bottom elements 26 extending upwardly or toward the head of the infant, and terminating in free ends 28. These side bottom elements are spaced from the top wall element providing spaces 30 which are open longitudinally at the upper portion, or toward the head of the infant, in direction opposite the transverse element 20. The infant can extend its arms through the spaces 30, and the open ends of the spaces enable greater movement of the arms, and allow considerable latitude in the placing of the device as a whole relative to the infant, in direction toward or from the head, i.e., horizontally as viewed in FIG. 1. The side bottom elements 26 may rest on the surface 14, or as the infant grows larger the top wall element may rest on the body of the infant, and in either case, the elements 26 would prevent the device as a whole from rocking sideways to any appreciable extent.

The side bottom elements 26 are provided with vertical slots 32 which open downwardly, and receive the axles 34 of the pull-toy 35 of FIG. 4 as referred to hereinbelow. The slots may be straight with parallel edges, throughout their length, or may be of keyhole shape, having enlargements 36 for accommodating the axles, as will be referred to again hereinbelow.

The top wall element 22 is provided with a channel 38 (see also FIGS. 9 and 10) extending longitudinally and bordered on its side edges by ribs 40 forming grooves 42 between the ribs and the bottom surface or floor of the channel. The upper portion of the main support member, including the top wall element 22, is curved to generally to follow the curvature of the body of the infant and to present an overall smooth and pleasing appearance. Preferably the channel 38 is entirely positioned below the top surface. FIG. 9 shows the rib and groove detail, and also shows an element of the tongues 44 on the bottle support 18 referred to hereinbelow.

The channel 38 is also provided with a forwardly positioned, rearwardly directed surface 46 (FIG. 10) constituting a stop for engagement by a corresponding element of a bottle support.

Preferably the main support member 16 is provided along its entire edges, except at the slots 32, with a cushioning element 48 in the form of a bead, as shown best in FIG. 11. This cushioning element may be of rubber, and applied in any suitable manner, and this element or beading or edging of course provides a cushioning effect against the body of the infant.

The bottle support 18 includes a bottom element or floor 50 and upright side walls 52. Preferably the side walls present a caricature as indicated at 54, both as to shape and pictorial effect to represent for example a dog as here shown. The bottom element of the bottle support extends outwardly beyond the side walls to form the tongues 44 identified above.

To put the bottle support in place, it is merely slid into and along the channel 38, with the floor 50 engaging and resting on the bottom surface of the channel and the bottle support being supported thereby, and the tongues 44 extending into the grooves 42; it is so moved until the forward end of the bottle support engages the stop 46. Preferably the top wall element 22 is inclined downwardly in forward direction and the bottle support member thereby remains in place by gravity.

Mounted in the bottle support is a bottle carriage 56 which directly supports the nursing bottle 58. The nursing bottle may be of conventional size and shape, and the bottle carriage 56 may be made mainly of suitable plastic material, flexible in nature if desired. The bottle carriage has an open top 60 for receiving the bottle, the nipple end of the bottle being fitted through a front end element 62 that is circumferentially continuous and constitutes a positive stop for preventing accidental movement of the bottle therethrough. The bottle carriage includes other structural elements, as desired, including side longitudinal elements 64 and a rear end element 66 in which is embodied a heavy weight 68 which may be of lead, for example, for moving the bottle to an upright position as referred to again hereinbelow.

The bottle is held in the bottle carriage 56 by suitable means, such as a binding strap 70, secured at one end to one of the side elements 64 as by a live hinge 65, i.e., formed integral with the adjacent element of the carriage, and having its other end free with means 72 cooperating with other means 74 for releasably securing the free end of the binding strap in position. This binding strap can be easily manipulated for removing it from securing position for placing the bottle in the carriage and removing it therefrom, and again putting it in securing position, such as by snapping it.

Suitable pivot means such as rivets 76 are provided between the bottle carriage 56 and the side wall 52 of the bottle holder for pivotally mounting the bottle carriage, and bottle, in the support.

In using the device, it is placed in position over the infant as represented in FIG. 1, and the bottle carriage and bottle is moved to active position represented in FIG. 1 in which the infant feeds therefrom. After the bottle is released, such as when the infant quits feeding, or falls asleep, the bottle carriage is moved, by the weight 68, to inactive position, represented in FIG. 8, which is upright, adjacent the vertical.

The bottle support 18 is provided with a music box 78 that is normally inactive. It is provided with a suitable actuating element 80 connected with a member 82 which may be a lever pivoted in one of the side walls 52, and connected with the element 80 at its lower end, and having its upper end in position for engagement by the bottle carriage, when the latter is moved to its inactive position. The elements 82, 80 are then actuated or moved, which turns on the music box, this warning the mother that the infant is finished feeding.

FIGS. 4 and 5 show the toy 35 referred to above, which may be of any suitable kind, such as a pull-toy in the form of a buggy or wagon as shown, and includes the axles 34 also referred to, on which wheels 88 are mounted, these supporting the body of the toy which may include a box 90, leaving short lengths of the axles laterally beyond the box, and the toy and the main support member 16 are so dimensioned and proportioned that the bottom elements 26 fit outwardly of the wagon box and on the axles. As the infant grows, and outgrows the feeding stage, and becomes big enough and old enough to pull the toy, the wagon and the nursing bottle holder together form a combination toy for the amusement of the child.

I claim:

1. A nursing bottle holder in conjunction with a pull toy, forming a combination toy, wherein, the bottle holder includes a main support member adapted to be placed in an active position over an infant in lying position, and having its longitudinal dimension in the head-to-body direction of the infant, and having a top wall element and depending side elements with bottom surfaces engageable with the surface the infant is lying on, said bottom surfaces being shaped to contact said surface and support said main member stably thereon, a bottle support demountably supported on the main support member, and a bottle carriage supported in the bottle support for positioning a bottle carried thereby for feeding by the infant, the depending side elements having vertical slots opening from said bottom surfaces in longitudinally spaced positions therealong, and the pull toy having axles and wheels supporting a body, and the main support member being fitted over the body of the pull toy, with the slots receiving the axles, and the pull toy supporting the nursing bottle holder, thereby constituting the combination toy.

2. A combination toy according to claim 1 wherein, the depending side elements of the main support member include bottom elements spaced downwardly from the top wall element, thereby forming spaces between themselves and the top wall element, and the spaces open longitudinally toward the head of the infant, the spaces receiving the arms of the infant and the open ends thereof facilitating placement of the nursing bottle holder over the infant by moving it longitudinally as the infant's arms move relatively into the spaces, the main support member has a generally continuous outer surface with a channel in the top wall element thereof extending longitudinally, the channel having an open end opposite the head of the infant, and a closed end adjacent the head forming a limiting stop element, the channel has ribs and grooves at its sides, and the bottle support is positioned in the channel, and includes tongues at its sides, and is put in position by sliding it into the channel through the open end of the latter, with the tongues on the bottle support riding in the grooves in the channel, to a position against the stop element, and the bottle carriage is pivoted for movement between an active position in which the nipple end of the bottle is in position for the infant to feed from the bottle, and an inactive position which the bottle is swung away from the infant's face.

* * * * *